United States Patent [19]

Fink et al.

[11] 4,029,596

[45] June 14, 1977

[54] DE-EMULSIFIER FOR BREAKING PETROLEUM EMULSIONS

[75] Inventors: Hans-Ferdi Fink, Essen-Ruttenscheid; Götz Koerner, Essen; Gerd Rossmy, Essen-Werden, all of Germany

[73] Assignee: Th. Goldschmidt AG, Essen, Germany

[22] Filed: Dec. 23, 1974

[21] Appl. No.: 535,841

Related U.S. Application Data

[63] Continuation-in-part of Ser. No. 471,585, May 20, 1974, abandoned.

[30] Foreign Application Priority Data

Nov. 8, 1973 Switzerland ..... 015675/73

[52] U.S. Cl. ..... 252/329; 252/345; 252/358

[51] Int. Cl.[2] ..... B01D 17/04

[58] Field of Search ..... 252/321, 358, 345, 330, 252/329, 324, 323

[56] References Cited

UNITED STATES PATENTS

| | | | |
|---|---|---|---|
| 3,378,418 | 4/1968 | Lissant | 252/330 X |
| 3,677,962 | 7/1972 | Koerner et al. | 252/345 |

OTHER PUBLICATIONS

*Emulsion Technology*: Chemical Publishing Co. Inc., (1943), p. 55.

*Primary Examiner*—Leland A. Sebastian
*Attorney, Agent, or Firm*—Toren, McGeady and Stanger

[57] ABSTRACT

Water, contained in petroleum in emulsified form, is separated by adding to the petroleum a conventional de-emulsifier and silica in fine particle form. The silica is advantageously in physical mixture with the de-emulsifier.

The amount of silica, calculated on the amount of de-emulsifier, is about between 0.1 to 10% per weight. The silica may contain up to 20 percent by weight of at least one of $TiO_2$, $ZrO_2$ and $Al_2O_3$.

12 Claims, No Drawings

DE-EMULSIFIER FOR BREAKING PETROLEUM EMULSIONS

CROSS-REFERENCE TO PRIOR APPLICATION:

This application is a continuation-in-part application of Ser. No. 471,585 filed May 20, 1974, now abandoned.

FIELD OF INVENTION

The invention is directed to de-emulsifiers and particularly to de-emulsifiers which are used for separating water from water containing petroleum (crude oil).

BACKGROUND INFORMATION AND PRIOR ART

A large amount of petroleum which is produced from petroleum-bearing formations is contaminated by water or aqueous solutions of sodium chloride or other salts in emulsified form. Such water containing systems occur predominantly in the form of water-in-oil emulsions. In practice, the water is separated by adding to the water-petroleum system very small amounts of emulsion breaking substances, hereinafter referred to as de-emulsifiers.

A large number of de-emulsifiers of varying compositions for the indicated purposes has been previously proposed. The reason that de-emulsifiers of widely diverging chemical composition have been suggested is primarily due to the fact that petroleum, dependent on its origin, has different composition and de-emulsifiers which may be suitable for breaking water-in-oil emulsions of crude oil from one location may be unsuitable for accomplishing this result if the crude oil emanates from a different district or source. This means that the activity of prior art de-emulsifiers is specific to the nature of the respective petroleum or crude oil composition.

Alkyl sulfates and alkylarylsulfonates, as well as petroleum sulfates in the form of amino-salts have been proposed for de-emulsification purposes.

Further, addition products of ethylene oxide to suitable compounds with active hydrogen atom, such as, for example, alkylphenols, castor oil, fatty acids, fatty alcohols and aldehyde resins, have been used for the indicated purpose. Information in respect of such prior art de-emulsifiers is contained in the book by N. Schönfeld "Oberflächenaktive Anlagerungsprodukte des Äthylenoxids", Wissenschaftliche Verlagsgesellschaft mbH, Stuttgart, 1959, page 295.

In spite of the fact that a very large number of de-emulsifiers are available on the market for breaking petroleum emulsions, it is well known in the art that it has not previously been possible to break all the occurring petroleum-water emulsions in a rapid, reliable and reproduceable manner and with relatively small amounts of de-emulsifiers.

The number and kind of suitable compounds for breaking petroleum emulsions has been significantly enlarged by introducing certain organosilicon compounds. Reference is thus had to U.S. Pat. No. 3,677,962 and German Auslegeschrift No. 1,937,130 which recommend the use of certain polyoxyalkylene-polysiloxane mixed block polymers for the indicated de-emulsification purpose. Although these compounds constitute a marked improvement, since they are exceedingly active for the indicated purpose, they are relatively expensive, a fact which stands in the way for their widespread use.

It has thus previously been proposed (see German Offenlegungsschrift No. 2250,920) to use de-emulsifiers for the indicated purpose which comprise mixtures of 0.2 to 30% by weight, preferably 0.5 to 10% by weight, of polyoxyalkylene-polysiloxane mixed block polymers whose polyoxyalkylene blocks have a molecular weight of 500 to 4000 and essentially consist of polyoxyethylene and polyoxypropylene blocks in a weight ratio of 40 : 60 to 100 : 0. The polysiloxane blocks comprise then 3 to 50 silicon atoms per block. The preparation also contains 70 to 99.8% by weight, preferably 90 to 99.5% by weight of customary silicon-free de-emulsifiers for breaking water-crude oil emulsions. Those polyoxyalkylene-polysiloxane mixed block polymers are preferred whose polyoxyalkylene blocks have a mole weight of 1000 to 3000.

If the polyoxyalkylene blocks consist of ethylene oxide and propylene oxide units, it is then preferred that the ethylene oxide units and the propylene oxide units are present in separate blocks. In such event it is also feasible to provide polyoxyalkylene blocks wherein several ethylene oxide blocks and propylene oxide blocks are connected in series.

If adducts of ethylene oxide and propylene oxide and water are prepared, with the former being used in blockwise manner, polyoxyalkylenediols are formed. If a monovalent alcohol is used as starting alcohol, such as, for example, methanol or another lower aliphatic alcohol, polyoxyalkylenemonools are obtained. However, multivalent alcohols, such as, for example, glycerine or sorbite may also be used as starting alcohols and in that event polyoxyalkyleneglycols with 3 or 6 hydroxyl groups are formed.

The polysiloxane blocks which contain 3 to 50 silicon atoms per siloxane block are normally linear or branched methylpolysiloxanes. However, polysiloxane blocks are also suitable in which the methyl groups are partially replaced by other lower alkyl groups or aryl groups.

The polyoxyalkylene blocks may be linked with the polysiloxane blocks either through SiOC-groups or through SiC-groups. The preparation of such compounds with SiOC-groups is disclosed, for example, in German Pat. No. 1,012,602. The compounds are prepared in a particularly simple manner if one proceeds according to the teaching of U.S. Pat. No. 3,115,512. Compounds with SiC-linking groups are obtained, for example, by forming addition products of ethylene oxide and propylene oxide to starting alcohols which are olefinically unsaturated and by then reacting these compounds with polysiloxanes containing SiH-groups. Such processes are disclosed, for example, in German Auslegeschrift No. 1,220,615. Many other processes of this kind belong to the state of the art for preparing such compounds.

The blockcopolymers to be used in accordance with the above proposal are liquid to wax-like solid substances which are capable of forming dispersions in water or which dissolve in water. For this reason they can be added directly to the petroleum containing emulsion to be broken or they may be admixed with the emulsion in the form of concentrated solutions or dispersions. Excellent results are also obtained if the blockcopolymers, to wit, the de-emulsifiers, are first dissolved in organic solvents, such as toluene or methanol, and the solutions are then added to the petroleum emulsions.

Examples for mixed blockcopolymers to be used for the indicated purpose may be represented by the following scheme wherein A indicates a polyoxyalkylene block while B represents a polysiloxane block:

A-B-A, B-A-B, A-B-A-B-A,

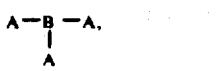

$[AB]_{n'}$ A in which p $n'$ is any suitable whole number, preferably 3 to 50.

Polyoxyalkylene blocks with OH or alkoxy groups at the end of the polymer chain serve preferably as terminal groups.

It will be appreciated that this enumeration is not exhaustive but only explanatory. The polyoxyalkylene block A may be represented by the formula:

$]-O(C_nH_{2n}O)_m]_r^Z$

In this formula $n$ may have a value of from 2.0 to 2.6. The value of $m$ is determined by the requirement that the mole weight of the polyoxyalkylene block should have a value of from 500 to 4000, preferably 1000 to 3000. Z stands for alkyl or aryl of the starting alcohol with which the ethylene oxide and propylene oxide form the addition product. Z may also symbolize alkylene or arylene, provided $r \geqq 2$. The index $r$ corresponds to the functionality of the alcohol which serves as starting alcohol. For example, if glycerine is used as starting alcohol, Z has then the structure:

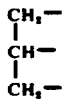

and $r$ has a value of 3. By contrast, if methanol is used as starting alcohol, Z is then $CH_3$ and $r + 1$. A polyalkyleneglycol obtained by the addition of alkylene oxide to water causes the formation of a block wherein Z = H; Z is eliminated if A is not in terminal position, $r$ in this instance is also equal to 1.

In the structural scheme shown above, B stands for the polysiloxane block. This polysiloxane block may, for example, have the following structure:

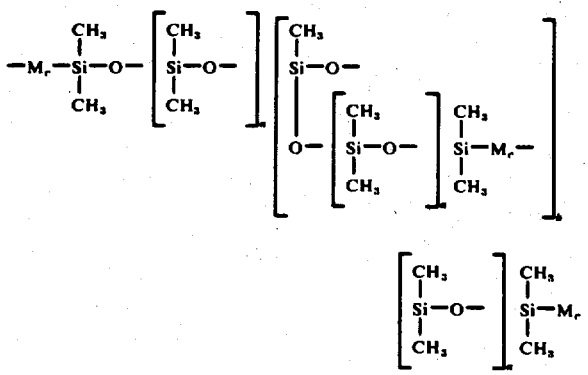

in this formula M stands for alkylene, while $c$ has the value of 0 to 1.

The indices $a$ and $b$ are variable. However, their magnitude is limited by the condition that each polysiloxane block must contain at least 3 but at the most 50 silicon atoms.

A second example for the structure of the polysiloxane block B is indicated by the following formula:

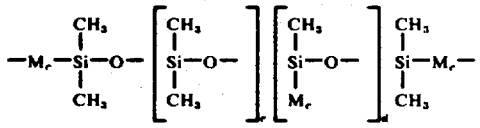

The meaning of the substituent M and of the index $c$ corresponds to the meaning given above. The indices $d$ and $e$ are variable, however, the sum of $d$ and $e$ must have a value of from 1 to 48. From this it follows that $d$ or $e$ may have a value of 0.

A still further example for the structure of the polysiloxane block B is represented by the following formula:

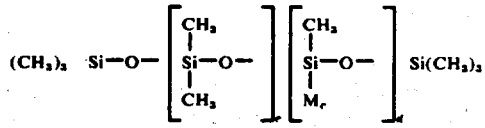

The meaning of the symbols in the formula corresponds to that of the preceding formula, however, $d$ in this formula must at least have a value of 1.

The linking of the blocks A and B may be accomplished through the —SiO-group or a group —SiYO. Y is a divalent alkylene group or another divalent group, such as, for example,

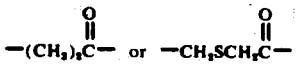

Another linking group which may be used is the group

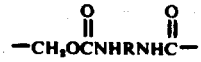

wherein R is a divalent hydrocarbon which may be substituted. For example, 2,4-toluylene is suitable for this purpose. The emulsion breaking effect of the mixed blockcopolymers is not substantially affected by the linking group linking the polysiloxane block with the polyoxyalkylene block.

Examples of preferred polyoxyalkylene-polysiloxane mixed block copolymers are those of the general formula $X(AB)_nAX$ wherein $n$ = 1 to 100, preferably 5 to 20, A stands for a polyoxyalkylene block of the general formula

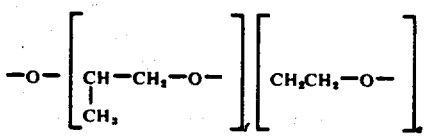

-continued

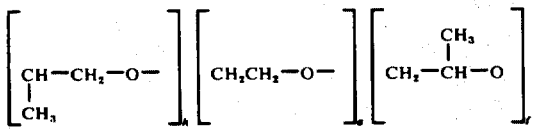

wherein $f = 0.5$ to 3;

$g = 6$ to 12;

$h = 8$ to 13;

$g : h$ preferably 0.9 : 1.0

X = is a monovalent hydrocarbon or preferably H

B is a polysiloxane block of the formula

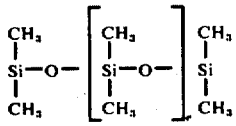

wherein $e = 1$ to 48, preferably 2 through 5, 9 through 12 and 20 through 23.

Preferred values for $f$, $g$ and $h$ are:

$f = 1.5$ $g = 8$ through 10 and $h = 9.5$ to 11.5.

Other polyoxyalkylene-polysiloxane mixed block polymers which are preferably used in the proposed mixture are those of the general formula

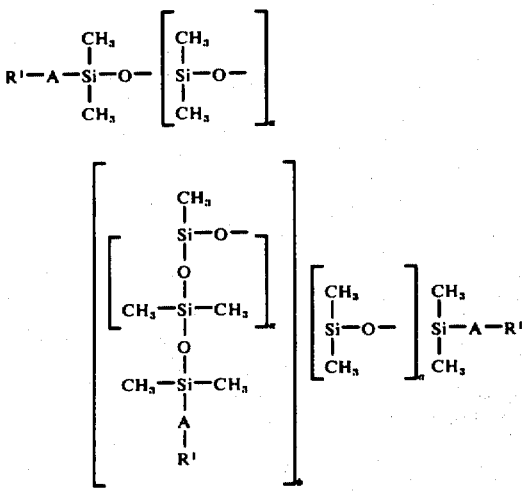

wherein $a = 0$ to 20

$b = 0.1$ to 10

A = polyoxyalkylene block and $R^1$ = monovalent hydrocarbon, for example, alkyl with 1 to 18 carbon atoms or phenyl.

Preferred values are:

$a = 3$ through 6

$b = 3$ through 10

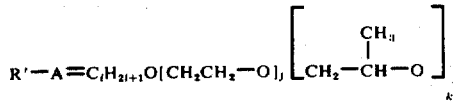

wherein $i = 1$ through 6;

$j = 25$ through 35, preferably 28.5 and $k = 5$ to 9, preferably 7.5.

The indices $n$, $m$, $r$, $a$, $b$, $c$, $d$, $e$, $f$, $g$, $h$, $i$, $j$, and $k$, which are used in the above formulas, should be considered as average values since the polyoxyalkylene-polysiloxane mixed block polymers are polymer mixtures.

Those polysiloxane blocks are moreover preferred which, prior to the linking with the polyoxyalkylene blocks, have been brought into statistical equilibrium in respect of molecular weight distribution and the distribution of the different siloxane units. As is generally known, the expression "brought into statistical equilibrium" is generally referred to in the art as equilibration.

The molecular weight of the polyoxyalkylene-polysiloxane mixed block polymers to be used in the proposed mixture should preferably be below 100,000.

In respect of the polyoxyalkylene-polysiloxane mixed block polymers whose siloxane block is linked with the polyoxyalkylene block through an SiOC linkage, compounds are preferred wherein the linking of the blocks is accomplished through a

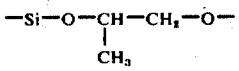

bridge.

Concerning the de-emulsifiers to be used in the proposed mixture which are devoid of silicon, primarily compounds comprising the following groups are to be considered:

I. Reaction products of alkyleneoxides with alkylphenolaldehyde resins. These are alkylphenol resins which are soluble in organic solvents and whose free hydroxyl groups have been reacted with ethylene oxide and/or propylene oxide. Alkylphenols which are required for this purpose are preferably monoalkylphenols with straight chain or branched alkyl groups of 4 through 18 carbon atoms in o- or p-position. Smaller amounts of bis-alkylated phenols may also be present. In order to convert these compounds into resins, formaldehyde is primarily used. Instead of formaldehyde proper, compounds may be employed which split off formaldehyde under conditions of alkaline or acidic condensation. However, it is also feasible to use formaldehyde or formaldehyde yielding substances in conjunction with acetaldehyde or higher aldehydes. The aldehyde quantity which is used for the condensation amounts to about 0.5 to 2.0 mole, preferably 0.9 to 1.1 mole, calculated on one phenol molecule. The reaction is effected in known manner in the presence of acidic or alkaline catalysts with or without addition of inert solvents. These alkylphenol-formaldehyde resins are oxalkylated according to known procedures. The amount of the oxalkylating agents to be employed is dependent on the one hand of the length of the alkyl groups contained in the starting phenol resin and on the other hand on the characteristics of the crude oil to be split. Generally, about 2 to 20 mole epoxide per hydroxyl equivalent are used. Such de-emulsifiers have been disclosed, for example, in U.S. Pat. Nos. 2,499,368, 2,499,370, 2,524,889, 2,560,333 and 2,574,543.

II. Block- and mixed polymers consisting of propyleneoxide and ethyleneoxide. These are particularly products as they are obtained if an adduct is formed of propyleneglycols of a mole weight of 500 to 5000, preferably 1,500 to 3,000, and 30 to 100% of ethyleneoxide, the ultimate molecular weight being thus increased. This group of de-emulsifiers also embraces products which are obtained by the addition of ethyleneoxide and propyleneoxide to compounds with 1 to 4 exchangeable hydrogen atoms as, for example, alkanols and polyalcohols, mono- and polyamines, oxamines and mono- and polycarboxylic acids. Compounds of this nature have been disclosed in French Pat. No. 1,069,615 and German Auslegeshrift No. 1,018,179.

III. a. Reaction products of the alkyleneoxidepoly adducts mentioned under (II) above and/or oxalkylated phenolformaldehyde resins of (I) above, with dicarboxylic acids such as succinic acid, glutaric acid, sebacic acid, benzenedicarboxylic acids and, particularly, adipic acid.

III. Products as they are obtained by cross linking alkyleneoxidepoly adducts of (II) above with each other and/or with oxalkylated alkylphenolformaldehyde resins of (I) above. As cross linking agents compounds are used which have 2 or 3 reactive groups which are suitable to react with the hydroxyl groups of the components to be cross linked. Such cross linkers are, for example, diisocyanates, such as hexamethylene-diisocyanate, toluylene-2,4-diisocyanate and toluylene-2,6-diisocyanate, 1,4- and 1,5-naphthaline-diisocyanate, diphenylmethane-diisocyanate, 4,4-dicyclohexylmethane-diisocyanate as well as phosphorusoxychloride and phosphorus trichloride.

The amount of cross linking agents to be used is in respect of bivalent cross linkers about 1/5 to ½ mole and with trivalent cross linkers about 1/10 to ⅓ mole per hydroxy equivalent of the products to be cross linked.

IV. Physical mixtures of products of the above groups (I) through (III).

SUMMARY OF THE INVENTION

It is the primary object of the invention to improve the de-emulsifying, to wit, emulsion-breaking action of known de-emulsifiers used for breaking water-petroleum emulsions.

Briefly, and in accordance with the invention, it has been ascertained that the de-emulsifying effect is significantly enhanced, especially the speed of water separation, if the emulsion system to be broken contains silica ($SiO_2$) in fine particle form. The silica is preferably admixed with the de-emulsifiers but the oxides may be added separately to the emulsion to be broken.

It has been ascertained that very small additions of silica are capable of significantly increasing the emulsion-breaking effect of the de-emuslifiers. Thus, amounts of 0.01% per weight, calculated on the de-emulsifier proper have proved to be effective. Generally, amounts in excess of 0.001% per weight are required to obtain a noticeable effect. The preferred range is 0.1 to 10% by weight. Larger amounts, to wit, in excess of 10% by weight calculated on the de-emulsifier, can, or course, be used. However, it has been ascertained that generally no increased de-emulsifying action is obtained thereby. According to one embodiment of the invention, the silica may contain up to 20 percent by weight of other metal oxides, preferably $TiO_2$, $ZrO_2$ and/or $Al_2O_3$.

The inventive addition of silica has a particularly pronounced effect on the emulsion-breaking effect of de-emulsifiers containing ethyleneoxide and/or propyleneoxide and those containing surface active organosilicon compounds, such as, for example, disclosed in German Auslegeshrift No. 1,937,130 and U.S. Pat. No. 3,677,962 and the other prior art compounds and compound mixtures mentioned hereinabove.

The inventive addition of silica not only enhances the emulsion-breaking effect of the de-emulsifiers proper, thereby accelerating and facilitating the removal of water from crude oil in a substantially quantitative manner, but the use of the inventive addition renders the de-emulsifier more universally applicable. In other words, due to the addition of silica, the de-emulsifiers proper are less dependent on the particular composition of the crude oil and the activity of the de-emulsifiers is significant in respect to all crude oil emulsions independent of their origin.

Further, the addition of the silica increases the separation speed.

Although silica of fine particle size in general can be used for the inventive purposes, it has been found that particularly excellent results are obtained with those oxides which are produced, in known manner, by flame hydrolysis and thus have a large surface area. Experiments have indicated that the best results are obtained with silica which has a BET surface of more than 50 $m^2$ per gram. The BET surface is determined by low temperature-nitrogen adsorption. A measuring method for this purpose is described by R. Haul and G. Dümbgen in Chem. Ing. Techn. 32 (1960), p. 349 and Chem. Ing. Techn. 35 (1963), p. 586.

The activity of the oxides in fine particle form, to wit, the silica and the other metal oxides, if present, may be still further increased by rendering the oxides hydrophobic. For this purpose, prior art methods may be used. Thus, agents for rendering the oxides hydrophobic are suitably metal soaps or other compounds, particularly organosilicon compounds, such as dimethyldichlorosilane, trimethylmonochlorosilane, octamethylcyclotetrasiloxane, and hexamethyldisiloxane or $(CF_3)_2CFO(CH_2)_3SiH_3$, which is obtained by reaction of $(CF_3)_2CFO(CH_2)_3SiCl_3$ with $LiAlH_4$. Further, polymeric organosilicon compounds are suitable, to wit, those which contain groups that assure the anchoring of the organosilicon compound on the substrate, such as, for example, SiOH, SiN (alkyl)$_2$. The silica can be pure or can contain small amounts of other oxides, especially $Al_2O_3$ in amounts of up to 20% by weight.

Generally, and from a practical point of view, it is recommended to use the de-emulsifiers in the form of organic preparations. Thus, for example, they may be dissolved or suspended in alcohol or aromatic solvents or mixtures of solvents. The silica in fine particle form, particularly if the oxides have been rendered hydrophobic, can be easily distributed in such systems and do not have any tendency for deposition or separation.

The invention will now be described by several Examples, it being understood that these Examples are given by way of illustration and not by way of limitation and that many changes may be effected without affecting in any way the scope and spirit of the invention as recited in the appended claims.

The substances mentioned in the following Examples are identified as follows:

De-emulsifier A

This is a cross-linked product of a polypropyleneglycol-ethyleneoxidepolyadduct and a nonolphenolformaldehyde resin reacted with ethyleneoxide. Toluylene-diisocyanate is used as cross-linker. The preparation of this product is disclosed in Example 1 of German Pat. No. 1,642,825.

De-emulsifier B

This is a mixture of one part by weight of nonylphenol-formaldehyde resin to which have been added 3 to 4 mole of ethyleneoxide per phenolic hydroxyl group to form an adduct, and one part by weight of a polyalkyleneoxyadduct with a polypropyleneglycol core of a mole weight of 2000, to which have been added ethyleneoxide so as to have, in the final product, an ethyleneoxide content of 38% by weight. The cross-linking is effected with 0.4 mole of phosphorus oxychloride.

Siliconepolyether C and D correspond to the formula $HA(BA)_{10}H$(C) and HABAH (D), respectively, wherein

A =

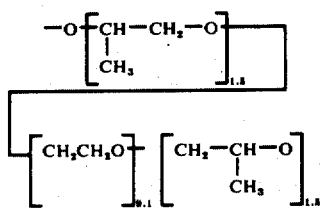

B =

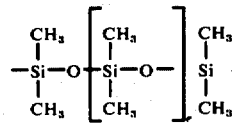

and $e$ has a value of 2.

The silica ($SiO_2$) Type A was obtained by flame hydrolysis and had been rendered hydrophobic. Dimethyldichlorosilane was used as hydrophobing agent. The BET-surface was 120 $m^2/g$. (The size of the primary particles was 10 to 40 m$\mu$, the carbon content was 0.9 to 1.3%.)

The silica Type B which was obtained by flame cohydrolysis of a mixture of siliconetetrachloride and aluminiumchloride had been rendered hydrophobic with $(CF_3)_2CFO(CH_2)hd\ 3SiH_3$ as hydrophobing agent. Silica Type B contained about 84% $SiO_2$ and 16% $Al_2O_3$. The BET-surface was 150 $m^2/g$. The size of the primary particles was 20 to 60 m$\mu$.

The sample of water containing crude oil was admixed at 50° C in each case with 15 ppm of active substance, to wit, de-emulsifier or de-emulsifier mixture. The addition of the de-emulsifiers was carried out from a 1% solution into a 1 : 1 mixture of toluene and methanol. After the addition, the mixture was shaken 200 times. The results are tabulated in Tables 1, 2, and 3.

The crude oil from a field in Oberbayern contained about 62% of water, while the oil from the Luneburger Heide contained about 21% of water.

Table 1

| | Crude oil from field in Oberbayern | | | Crude oil from field in Luneburger Heide | | |
|---|---|---|---|---|---|---|
| | Water separation in % after n minutes | | | | | |
| Type of De-emulsifier | 10 min | 30 min | 180 min | 10 min | 30 min | 180 Min |
| De-emulsifier A | 39 | 41 | 44,5 | 15 | 16 | 19 |
| De-emulsifier B | 33 | 44.5 | 45.8 | 14 | 16 | 17 |
| De-emulsifier A + 1% $SiO_2$ Type A. | 49 | 50 | 50.5 | 19 | 20 | 20 |
| De-emulsifier B + 1% $SiO_2$ Type A | 41 | 47 | 48.5 | 18 | 19 | 20 |
| De-emulsifier A + 0.1% $SiO_2$Type A | 44 | 48.5 | 50 | 18 | 19 | 20 |
| De-emulsifier A + 0.01% $Sio_2$ Type A | 43 | 47 | 48.5 | 17 | 18 | 20 |

Table 2

| | Crude oil from field in Oberbayern | | |
|---|---|---|---|
| | Water separation in % after n minutes | | |
| Type of De-emulsifier (15 ppm active substance) | 10 min | 30 min | 180 min |
| Siliconepolyether D | 45 | 48 | 50 |
| Siliconepolyether C | 48.5 | 51.5 | 52 |
| Siliconepolyether D + 1 % $SiO_2$ Type A | 50 | 52 | 52.5 |
| Siliconepolyether C + 1 % $SiO_2$ Type A | 54 | 55 | 56 |
| Siliconepolyether C + 0.1 % $SiO_2$ Type A | 53 | 55 | 56 |

Table 3

| | Crude oil from field in Oberbayern | | |
|---|---|---|---|
| | Water separation in % after n minutes | | |
| Type of De-emulsifier | 10 min | 30 min | 180 min |
| 14 ppm De-emulsifier A + 1 ppm Siliconepolyether C | 49.5 | 52.5 | 52.5 |
| as above, however, + 1 % $Sio_2$ Type A | 51.5 | 55.5 | 56.5 |
| as above, however, + 1 % $SiO_2$ Type A | 49.5 | 54 | 54.5 |
| as above, however, + 10 % $SiO_2$Type B | 58 | 61 | 61.5 |
| as above, however, + 1 % $SiO_2$ Type B | 53 | 55.5 | 57 |
| 14 ppm De-emulsifier B + 1 ppm Siliconepolyether D | 49 | 51.5 | 55.5 |
| as above, however, + 10 % $SiO_2$ Type A | 56.5 | 59 | 59.5 |
| as above, however, + 1 % $SiO_2$ Type A | 55 | 57 | 57.5 |
| as above, however, + 1 % $SiO_2$ Type B | 60 | 61 | 61 |
| as above, however, + 0.01 % $SiO_2$ Type B | 57.5 | 61 | 61 |

What is claimed is:

1. In a de-emulsifier for breaking a petroleum-water emulsion, wherein the de-emulsifier contains ethylene oxide and propylene oxide, the improvement which comprises that the de-emulsifier contains in excess of 0.001% by weight of silica having a BET surface in excess of $50m^2/g$.

2. The improvement as claimed in claim 1, wherein the de-emulsifier contains between about 0.1 to 10% by weight of silica in fine particle form.

3. The improvement as claimed in claim 1, wherein said silica has been produced by flame hydrolysis.

4. The de-emulsifier of claim 1 wherein the de-emulsifier contains surface-active organosilicon compounds.

5. In a de-emulsifier for breaking a petroleum-water emulsion wherein the de-emulsifier contains ethylene oxide and propylene oxide, the improvement which comprises said de-emulsifier containing an excess of 0.001% by weight of silica in fine particle form, said silica having been rendered hydrophobic.

6. The improvement as claimed in claim 5, wherein the silica has been rendered hydrophobic by treating the oxide with an organosilicon compound.

7. The improvement as claimed in claim 5, wherein 0.1 to 10% by weight of silica, calculated on the amount of de-emulsifier, are contained in said preparation.

8. The improvement of claim 7, wherein the silica contains up to 20% by weight of at least one of $TiO_2$, $ZrO_2$and $Al_2O_3$in physical admixture therewith.

9. In a de-emulsifier for breaking a petroleum-water emulsion wherein the de-emulsifier contains ethylene oxide and propylene oxide, the improvement which comprises said de-emulsifier containing an excess of 0.001% by weight of silica in fine particle form being physically admixed with up to 20% by weight of at least one metal oxide selected from the group consisting of $TiO_2$, $ZrO_2$, and $Al_2O_3$, and wherein said silica and said metal oxide have been rendered hydrophobic.

10. In a liquid preparation suitable for breaking petroleum-water emulsions wherein a de-emulsifier containing ethylene oxide and propylene oxide is dissolved or suspended in a liquid carrier, the improvement which comprises said preparation also containing at least 0.1% of silica in fine particle form wherein said silica has been produced by frame hydrolysis and has been rendered hydrophobic.

11. In a method for breaking a water-in-petroleum emulsion, the improvement which comprises adding to said emulsion a de-emulsifier containing ethylene oxide and propylene oxide and at least 0.1% by weight, calculated on the amount of de-emulsifier, or silica in fine particle form, said silica having been produced by frame hydrolysis and having been rendered hydrophobic.

12. The improvement of claim 11, wherein the silica contains up to 20 percent by weight of at least one of $TiO_2$, $ZrO_2$ and $Al_2O_3$in physical admixture therewith.

* * * * *